United States Patent [19]

Kerkhofs

[11] 4,233,346

[45] Nov. 11, 1980

[54] METHOD AND APPARATUS FOR APPLYING A PLURALITY OF SUPERPOSED LAYERS TO A WEB BY CURTAIN COATING

[75] Inventor: Jacques G. Kerkhofs, Diepenbeek, Belgium

[73] Assignee: AGFA-GEVAERT N.V., Mortsel, Belgium

[21] Appl. No.: 15,147

[22] Filed: Feb. 26, 1979

[30] Foreign Application Priority Data

Mar. 1, 1978 [GB] United Kingdom ..... 811578

[51] Int. Cl.[2] ..... B05D 1/30

[52] U.S. Cl. ..... 427/345; 118/324; 118/325; 118/DIG. 4; 427/411; 427/419.1; 427/420; 430/935

[58] Field of Search ..... 118/324, 325, DIG. 4; 427/420, 411, 419 R, 345

[56] References Cited

U.S. PATENT DOCUMENTS

| | | | |
|---|---|---|---|
| 3,508,947 | 4/1970 | Hughes | 118/324 X |
| 3,867,901 | 2/1975 | Greiller | 118/325 X |
| 3,968,772 | 7/1976 | Greiller | 118/325 |
| 4,019,906 | 4/1977 | Ridley | 427/420 X |
| 4,041,897 | 8/1977 | Ade | 427/420 X |
| 4,060,649 | 11/1977 | Coleman | 427/420 X |
| 4,135,477 | 1/1979 | Ridley | 427/420 X |

FOREIGN PATENT DOCUMENTS

| | | | |
|---|---|---|---|
| 908653 | 10/1962 | United Kingdom | 118/DIG. 4 |
| 1099127 | 1/1968 | United Kingdom | 118/DIG. 4 |

*Primary Examiner*—Shrive P. Beck
*Attorney, Agent, or Firm*—William J. Daniel

[57] ABSTRACT

Method and apparatus for applying a plurality of superposed layers to a web by curtain coating in which only some of the plurality of layers are, and in the extreme case only one layer is, in contact with the curtain guides. The width of the remaining layers is smaller than the width determined by the curtain guides, and preferably smaller than the width of the web.

13 Claims, 8 Drawing Figures

METHOD AND APPARATUS FOR APPLYING A PLURALITY OF SUPERPOSED LAYERS TO A WEB BY CURTAIN COATING

The present invention relates to a method and apparatus for coating a travelling web with a plurality of layers of coating composition, by means of curtain coating.

In curtain coating, a travelling web is coated by a free-falling curtain of coating liquid that is caused to impinge onto the travelling web to form a layer thereon. The formation of one layer on a web by curtain coating has long been known. The formation of a plurality of distinct layers on a web is disclosed in British Pat. No. 1,276,381 filed June 3, 1969 by Eastman Kodak Company, that deals in particular with the production of multilayer photographic material.

In curtain coating the width of at least one the free falling curtain is maintained by edge guides which define the lateral boundaries of the curtain. These edge guides are stationary members that extend downwardly from the initial point of free fall of the curtain and that may occasionally slightly converge. In the absence of edge guides, the tendency towards a lower state of energy would cause the curtain to neck in appreciably, or to split up into a number of strands and attainment of the lowest energy state would correspond with a circular cross-section of such strands. The wetting contact of the edges of the curtain with the guides causes non-uniformities in the coating when the full width of the curtain is applied to the moving web. By making the curtain wider than the web to be coated by an amount at least equal to this non-uniform region at each edge, the coating applied to the web becomes substantially uniform, apart from the formation of beaded edges under the influence of surface tension effects.

When coating a single layer on a travelling web, the coating liquid at the margins of the curtain which overflows the edges of the travelling web may be collected and recirculated into the coating liquid supply. However, when two or more layers are coated simultaneously while in face-to-face contact with each other, the liquid overflows at the edges of the web are in fact mixtures of two or more different compositions and thus cannot be recirculated.

Such overflows are in practice a waste of material, and it is only in case that they contain valuable constituents, such as silver halide compounds in the coating of light-sensitive layers in the production of photographic material, that recovery of such constituents may be carried out to limit the losses of material.

There has been disclosed a curtain coating method for overcoming the aforementioned waste of material. According to British Pat. No. 1,429,260 filed Oct. 12, 1973 by Ciba Geigy, there is provided a method for coating a travelling web with at least one layer of a liquid composition, comprising the steps of moving the web along a path through a coating zone and forming at the coating zone a free-falling vertical curtain which extends transversely of the path and impinges on the travelling web to deposit thereon a coating, the free-falling curtain being composed of at least two separately formed free-falling partial curtains which are joined edge to edge, one partial curtain constituting an edge region of the integral curtain and the other or others constituting a central region and another edge region of the integral curtain. Preferably three partial curtains are provided which constitute the central region and the two edge regions of the integral curtain respectively. The method enables the use, in the edge regions, of cheap liquids that are compatible with the main coating liquid or liquids used in the central region and thus when they overflow the edges of the web being coated, they need not necessarily be collected for recirculation.

Moreover, if the width of the central region of the curtain is so adjusted that it is smaller than the width of the web being coated, then the liquid that overflows the edges of the web may preferably be collected and recirculated into the coating liquid supply for the formation of the edge regions.

This improved method shows the following inconveniences.

The technical problems that are already considerable in the construction of a coating head for two or more layers are further increased by the necessity to provide two additional orifices for the formation of the two edge regions of the curtain. The lateral position of such two additional orifices with respect to the central orifice or orifices is critical since the two edge regions of the curtain should properly meet the central region. The two additional edge orifices are connected to an additional liquid supply and this additional circuit requires its own control of feed rate and heating, its cleaning and deaeration, etc.

The main problem is, however, that the rheological properties of the liquid composition used for the formation of the edge regions of the curtain must be compatible with the rheological properties of the liquid or liquids of the central region of the curtain. The adjustment of the mentioned rheological properties, more particularly the wetting power, does not raise great difficulties in case the central region of the curtain comprises only one layer. In the case of two or more layers, however, it will be understood that, since different layers usually contain different wetting agents, it can be extremely difficult to find a further wetting agent or agents for the liquid composition for the edge regions that is compatible with all the constituents of the layers of the central region of the curtain, and it may therefore result that existing coating formulation has to be completely reconsidered in order to obtain the required compatibility. This is notably the case in the field of photography wherein the coating compositions for the formation of light-sensitive silver halide layers, colour filter layers, antistress layers and others, all contain quite different types and different amounts of wetting agents that in practice are always the result of considerable emperical experience to obtain coating compositions that permit the defect-free coating and drying of layers at a given web speed.

It is the object of the present invention to provide a method and apparatus for multiple curtain coating wherein the problems related with the edge regions of the curtain are overcome in a more simple way.

According to the present invention, a method of coating a travelling web with a plurality of layers of coating composition, comprising moving said web along a path through a coating zone, forming distinct flowing layers of liquid coating compositions, flowing said layers into face-to-face contact with each other to form a composite layer and forming from said composite layer within the coating zone a free-falling curtain with extends transversely of said path and is held so by adherent contact of its lateral edges with curtain guides, and which curtain impinges on said moving web thereby forming thereon a coating comprised of distinct superposed layers of said coating compositions, is characterized thereby that at least but not all of the plurality of layers has a width that exceeds the width of the web, and that the width of the remaining layers is smaller than the overall width of the curtain.

The term "plurality" as used in the present statement of invention and throughout the specification denotes at least two layers.

The term "web" denotes lengths of materials such as paper, cellulose triacetate and polyethylene-terephthalate of several hundreds of meters, but it encompasses also striplike materials as well as flexible or rigid sheets that lend themselves to curtain coating by their appropriate transport through the coating zone.

The terms "width of the layer or layers", "overall width of the curtain" and "width of the central region of the curtain" denote, unless otherwise specified, the width of such layer(s) or such curtain measured along the line of intersection of them with the web, i.e. along the line of impingement on the web.

The layer which has a width exceeding that of the web, or at least one of the layers having a width exceeding that of the web if there are in fact more than one such layer, will be in adherent contact with the curtain guides. If there is more than one such layer wider than the web, preferably all such wider layers contact the said guides.

According to a preferred embodiment of the invention, only one layer has a width that is greater than the width of the web and that is in contact with the curtain guides, whereas the other layers have a width whereby they do not overflow the web. In this way the coating composition of the wider layer that overflows the edges of the web can be collected and recirculated into the coating liquid supply for that one layer.

In contrast with the method disclosed in the British Pat. No. 1,429,260, mentioned hereinbefore, the liquid that overflows the edges of the web in the present invention does not need any adjustment of its rheological properties in view of the properties of the central region of the curtain, since the edge regions of the curtain simply form an integral part of the corresponding layer of the central region of the curtain, that had already previously been adjusted to be compatible with the corresponding superposed layer. The liquid of one layer that overflows the edges of the web need not be a cheap liquid but may be an expensive such as an aqueous silver halide gelatin dispersion used in the production of photographic material, since the overflows thereof may be collected and recirculated to the supply for the formation of the one layer of greater width.

The only point that should be considered in carrying out the method according to the invention is that the basic condition for the formation of a stable curtain, namely the flow rate of the curtain being at least about 50 milliliters per second per meter of curtain width (hereinafter expressed as $ml \cdot s^{-1} \cdot m^{-1}$), should be fulfilled. This condition has long been known and reference may be made, for instance, to the articles "A study of the behaviour of a thin sheet of moving liquid" by D. R. Brown in the Journal of Fluid Mechanics 10 (1960), p. 297/305, "Curtain coating with PVDC dispersions" by R. W. Willis, in Modern Plastics, 40 (1962) p. 134/142, and the preprints by E. R. Cox of the 22nd Plastics Paper Conference in Chicago, Illinois, U.S.A. from October 30 to Nov. 1, 1967, wherein the mentioned minimum value for the flow rate of a curtain is disclosed as 0.5 cc/s/cm.

The value of 50 $ml \cdot s^{-1} \cdot m^{-1}$ is a lower limit that in practice, in particular in the coating of aqueous dispersions, often cannot be attained and therefore a value of 70 to 90 $ml \cdot s^{-1} \cdot m^{-1}$ should be considered in a great number of coating proceedings as practical the lower limit of the flow rate.

In case the minimum flow rate is not attained in the method according to the present invention, the following measures may be taken, either alone or in combination.

First, the flow rate of all wider layers of the curtain may be made greater at the edge regions of the curtain than at the central region of the curtain. This measure can be carried out by locally increasing the width, i.e. thickness of the slotlike orifices through which a wider curtain layer is formed. For instance, one or both walls that define the orifice can be provided at the lateral ends with a recessed portion at the lateral ends with a length corresponding with the width of the desired edge region of the curtain. Such local increase of the thickness of the orifice will be small, considering that the rate of flow is proportional to the third power of the orifice thickness. An occasional difference in the initial velocity of the coating composition at the edge regions, as compared with the velocity at the central region of the orifice, is completely unimportant, since in curtain coating it is by far the height of the curtain that determines the final velocity of the curtain in accordance with the formula:

$$v_c = \sqrt{v_i^2 + 2gh}$$

wherein:

$v_c$ is the curtain velocity at coating (impingement on the web)

$v_i$ is the initial velocity of the curtain, g is the gravity constant h is the height of the curtain.

Second, two or more face-to-face layers, rather than a single layer (which is the preferred case), may extend over the full curtain width. Whereas in this manner a sufficiently great flow rate may be obtained at the edge regions of the curtain, the advantage of recirculation of the liquid that overflows the edges of the web is lost since the collected liquid will be a mixture of at least two different coating compositions. This fact does not necessarily mean that the method causes considerable waste since by appropriate selection of the layers of a composite curtain that will overflow the edges of the web to be coated, losses of expensive coating compositions may still be kept low. For instance, in the coating of a photographic colour material by means of a composite curtain that comprises a green-sensitive silver halide layer, a red-sensitive silver halide layer, a yellow filter layer, a blue-sensitive silver halide layer and an antistress layer, the yellow filter layer and the antistress layer may be formed at the full curtain widths whereas the three other, expensive silver-containing layers may be formed at a width that is slightly smaller than the width of the web so that in fact only the two less expensive layers must be considered as a loss of coating material.

Third, the viscosity of the layer or layers as the case may be, that establish the full curtain width may be increased to provide an increased support for the edge regions of the curtain. The effect of this measure is, however, limited and consideration should be given to the preparation of the coating composition and the deaeration of the feed circuits, in case the viscosity becomes greater than, say 300 mPa.s (1 mPa.s=1 cp).

According to another preferred embodiment of the invention, the surface tension of all layers of greater width is higher than the surface tension of the other layers that have a width equal to the central region of the curtain. In that way the central region of the curtain will maintain a profile with slightly diverging edges. As a consequence thereof the thickness of the central region of the curtain will be slightly decreased near its edges so that, as the curtain is coated on the travelling web, surface tension effects at the edges of the coating on the web that tend to form beaded edges, may have less pronounced effects whereby the beaded edges of the web coating may be less pronounced and the coating thickness be more uniform near the edges of the web. It should be noted that the non-uniformity as such of the web coating at the edges of the web is not of paramount importance, since in practice such non-uniformity is nearly always confined within the edge knurled region of a film and the marginal film portion carrying the edge knurling is trimmed off after the drying of the coated material. However, the beaded edges of the web coating represent an additional amount of liquid vehicle that must be evaporated in the drying of the coatings and thus the drying capacity of a drying installation may put a limit on the coating speed.

The present invention provides also an improved apparatus for multiple curtain coating. According to the invention, an apparatus for coating a web with a plurality of layers, and comprising a hopper provided with a plurality of separate cavities to which the distinct coating compositions may be fed, a plurality of elongate slotlike orifices communicating respectively with the plurality of cavities, means for bringing the layers of coating composition that have been formed by the flowing of the compositions through the orifices, into superposed contact with each other to form a composite layer that flows as a free-falling curtain extending traversely of the path of movement of the web through the coating zone and in adherent contact at its lateral boundaries with downwardly extending curtain guides, is characterized in that at least one but not all of the plurality of slotlike orifices have a length that is substantially equal to the initial distance between the curtain guides, with the remainder of the slotlike orifices have a lesser width length of said one or more orifices, the centres of said plurality of orifices preferably being disposed in one common center plane. If there is more than one orifice having a length greater than the web width, all of such longer orifices preferably have a length equal to the initial distance between the curtain guides.

Interesting embodiments of the apparatus according to the invention are as follows;

(1) A single slotlike orifice has a length that equals the distance between the curtain guides, all the other orifices being shorter than said one orifice; and (2) At least one of the slotlike orifices that has a length corresponding with the initial distance between the curtain guides, has edge regions of increased lip spacing thereby to produce in operation at these edge regions a rate of flow greater than the rate of flow at the corresponding central region of said orifice.

While the present invention has been developed in particular for use in connection with the manufacturing of photographic material, it should be understood that the present invention is not limited to the production of this particular type of material. Other materials that lend themselves to multi-curtain coating in accordance with the method of the invention are, for instance, thin bands or strips of steel that are to be covered by a first layer of decorative paint or composition, e.g. a first layer that contains finely divided particles of aluminium or the like to obtain a "bronze" or "metal-like" finish, and a transparent top layer that seals and protects the first layer.

The invention will now be described by way of example with reference to the accompanying drawings wherein.

Figure 1:
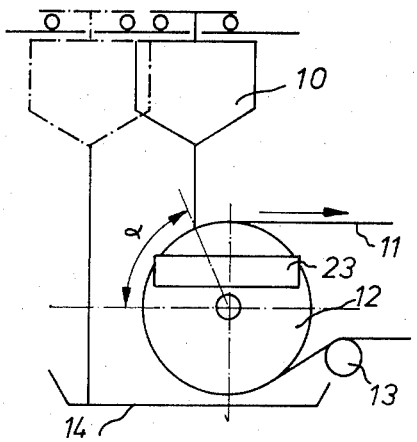
FIG. 1 is a diagrammatic side elevation of one embodiment of a coating apparatus for performing the method according to the invention.

Referring to FIG. 1, a coating head 10 of the extrusion-type is arranged for the simultaneous coating of two layers on a moving web 11. The web 11 is moved through the coating zone along a path that is determined by a web-supporting roller 12 to which the web is advanced over a guide roller 13. The web has a width that is greater than the width of the roller 12, so that it extends at both sides over the roller. The coating head is arranged for movement from an inoperative position shown in broken lines, into an operative position shown in drawn lines. In the inoperative position, the deaeration of the coating head and its related supply circuit, and the starting of the formation of the curtain may be carried out. The coating composition tha flows downwardly during this preliminary phase of the coating procedure is collected in a pan 14 and is to be considered as waste since the compositions for the two layers have become intermixed. Occasionally, critical or expensive constituents may be recovered from the collected mass of liquid.

When the curtain is stably flowing downwardly, the coating head may be moved by suitable means into operative position. In that position the composite curtain flows on the web at a position in the coating zone that is situated in the upper left-hand quadrant of the web-supporting roller 12. The curtain is held during its free fall with its edges in adherent contact with stationary curtain guides 15 and 16 as may be seen in FIG. 2. In the present embodiment, the curtain guides consisted of metal rods that were provided with a sleeve of plastic that showed good wetting properties with respect to the coating composition, namely nylon. The curtain guides have been illustrated parallel with each other in the drawing, but they may also converge towards each other, depending on the rheological properties and the rate of flow of the curtain.

Figure 3:
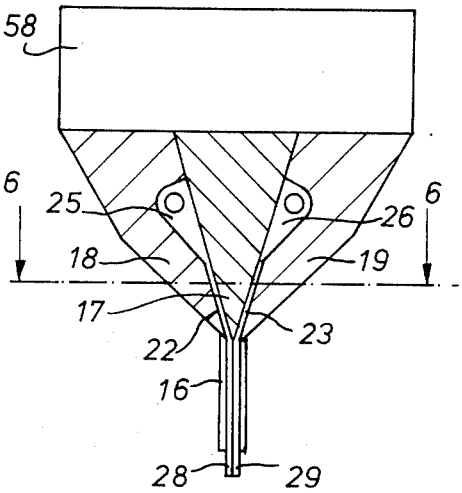
FIG. 3 is a vertical cross-sectional view on line 3—3 of FIG. 2.
Figure 2:
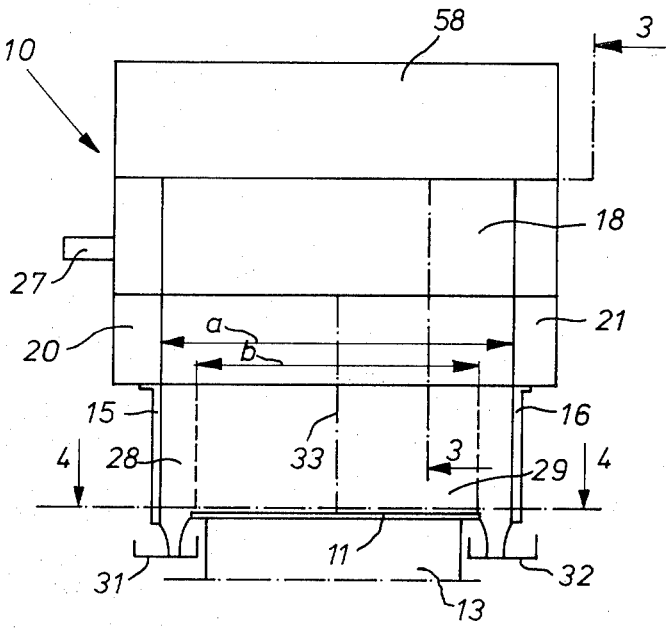
FIG. 2 is a front elevational view of the apparatus of FIG. 1.

The construction of the coating head is illustrated in more details in FIGS. 2 and 3, wherein it may be seen that the head comprises essentially a central wedge-like lip 17 and two outer lips 18 and 19 that determine two elongate parallel orifices 22 and 23, side walls such as 20 and 21, and a supporting mechanism 22 that has been illustrated as a block but that actually comprises means that permit the outer lips 18 and 19 to be swung away from the central lip for cleaning the head, for the installation of small strips of plastic, metal or the like at the lateral extremities of one of the orifices to reduce the effective length thereof. The coating compositions are fed to the cavities 25 and 26 of the coating head via a lateral connection such as 27 shown in FIG. 2. In FIG. 2 the length of the orifice 22 is illustrated by a, whereas the lengthof the orifice 23 is illustrated by b. These lengths correspond practically with the initial widths of the respective layers 28 and 29 of the curtain. The edges of the layer 29 are indicated in broken lines in FIG. 2. The orifices 22 and 23 have a common centre line as indicated by the dash and dot line 33.

Figure 4:
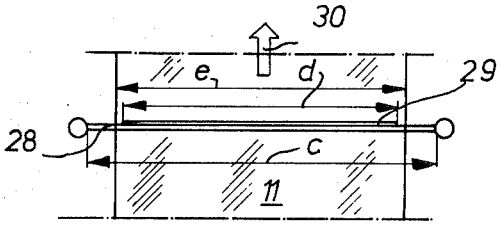
FIG. 4 is a plan view on line 4—4 of FIG. 2.

The width of the two layers of the curtain at the moment they contact the web is indicated in FIG. 4 by c for the layer 28 and by d for the layer 29. The width of the web 11 is indicated by e. The arrow 30 indicates the direction of movement of the web 11 and it is thus clear that in the illustrated embodiment the wider layer 28 of the curtain will enter into contact with the web. It should be noted that for the sake of clarity, the line 4—4 has been drawn separated from the upper surface of the web 11 in FIG. 2; in fact this line should coincide with said surface.

The part of the coating composition of the curtain that overflows the edges of the web is collected in pans 31 and 32 and may be directly recirculated to the supply tank of coating composition that is in communication with the manifold 25. Such recirculation is possible since it is only the liquid of the edge regions of the wider curtain layer 28 that overflows the edges of the web. The layer 29, on the contrary, is integrally applied to the web.

Figure 5:
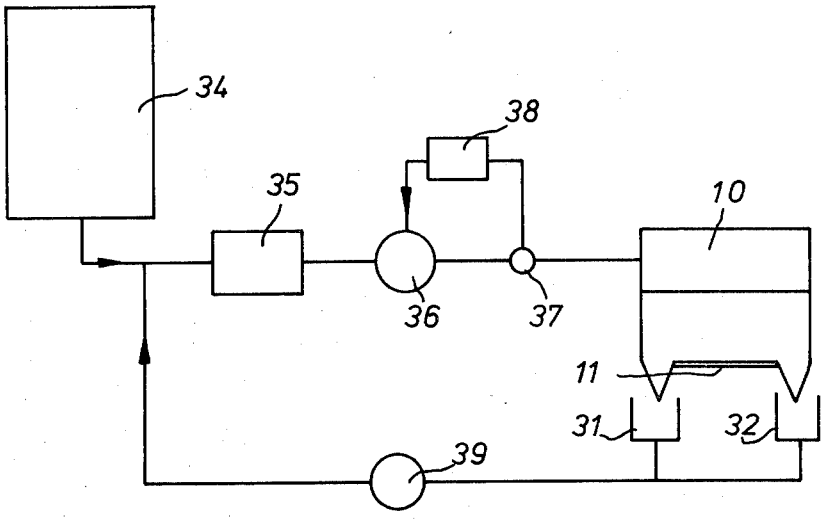
FIG. 5 illustrates the recirculation of the liquid that overflows the edges of the web.

The recirculation of the coating composition that overflows the edges of the web has been illustrated in FIG. 5 wherein 34 is a supply tank for the coating composition, 35 is a deaeration apparatus, 36 is a positive displacement type pump, for instance a gear pump, 37 is a device for measuring the rate of flow and 38 is a controller for controlling the pump 36 in response to the output signal from the flow meter 37, and 10 is the curtain coater. The part of the coating composition that overflows the edges of the web 11 is collected in the pans 31 and 32 and recirculated by a pump 39, for instance a centrifugal type pump, to the deaeration apparatus 35. The installation comprises a second supply vessel and its associated elements, not shown in the drawing, for the feeding of the coating composition for the formation of the narrower layer, i.e. that has a width that does not exceed the width of the web, and that consequently is integrally coated to the web.

Figure 6:
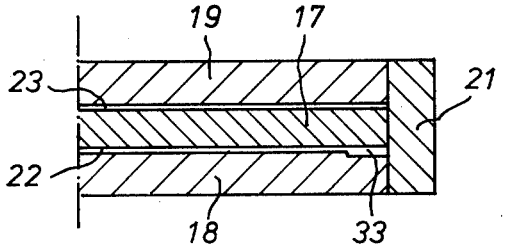
FIG. 6 is a partial horizontal sectional view on line 6—6 of FIG. 3.

FIG. 6 illustrates a modified coating head according to FIGS. 2 and 3 that may be used when the rate of flow of the curtain, more in particularly of the edge regions of the curtain, is not sufficiently great to maintain a stable curtain. In such case the lip spacing, i.e. thickness, of the orifice of the coating head through which the wider layer of the curtain is formed may be locally increased at the edge regions, as indicated by the recessed zone 33 in FIG. 6 at one lateral side of the coating head. The increase of the lip spacing has been exaggerated in the drawing for the sake of clearness; in practice such increase will be small in accordance with the law determining the rate of flow through an orifice, as mentioned already in the specification.

Figure 7:
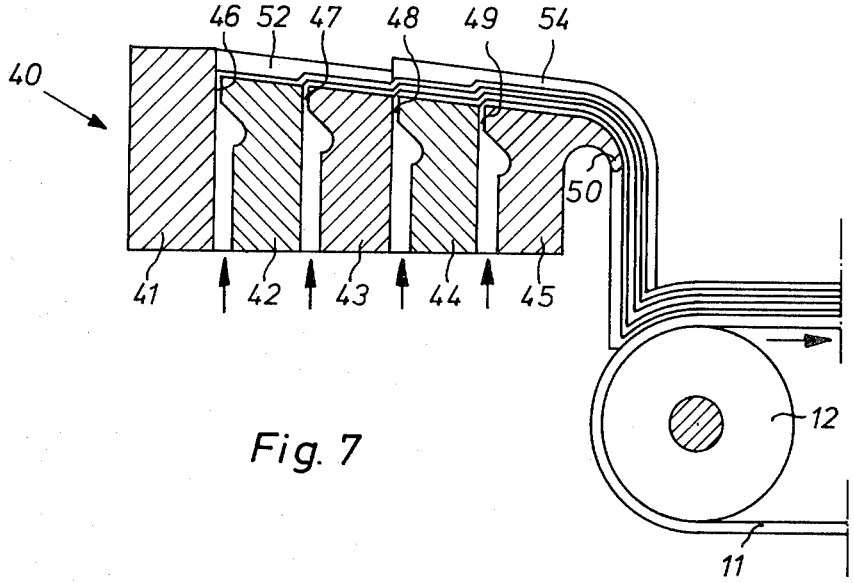
FIG. 7 is a cross-sectional view of another embodiment of a coating apparatus for performing the method according to the invention.
Figure 8:
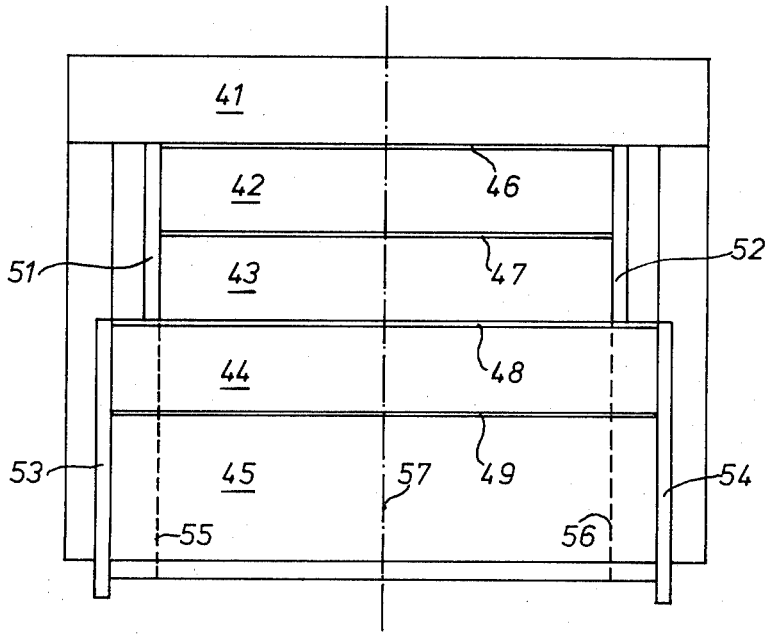
FIG. 8 is a plan view of the apparatus according to FIG. 7, the web-supporting roller being omitted.

A second embodiment of an apparatus for performing the method according to the present invention is shown in FIGS. 7 and 8. The apparatus here is a curtain coating apparatus of the slide hopper type that is arranged for the formation of four layers applied successively onto each other. Slide hoppers of this type are described in more detail, for instance in British Pat. Nos. 1,276,144 and 1,276,381, both filed June 3, 1969 by Eastman Kodak Company.

The hopper 40 comprises five constituent elements 41 to 45 that define four spaced parallel elongated orifices 46 to 49 for the formation of the successive layers. The coating compositions for the formation of the distinct layers are pumped to the coating head through corresponding ducts indicated by the corresponding arrows. The foremost or lower element 45 terminates in a lip 50 from which the superposed layers may fall downwardly as a curtain onto a web 11 conveyed through the coating zone about a roller 12. The slotlike orifices of the coating head have different lengths as may be seen in FIG. 8, wherein the upper orifices 46 and 47 have a length that is smaller than the length of the lower orifices 48 and 49. The centres of the four orifices lie in a common centre plane, as indicated by the dash and dot line 57. The layers of coating compositions formed through the first or lower two orifices are in contact along their lateral boundaries with edge guides 51 and 52 whereas the next two layers are in contact with edge guides 53 and 54. The layers formed through the orifices 46 and 47 overflow the layers formed through orifices 48 and 49 and may maintain, dependent on their respective rheological properties as will be further dealt with in the examples hereinafter with reference to FIGS. 1 to 3, their initial width, as indicated by the broken lines 55 and 56. The edge guides 53 and 54 extend beyond the lip 50 vertically downwardly and thereby form the edge guides for the free falling curtain. The width of the web may correspond with, or be slightly narrower or broader than the width of the central region of the curtain that is within the broken lines 55 and 56. The edge regions of the curtain that overflow the edges of the web 11 may be collected in suitable pans as described hereinbefore with reference to the extrusion-type hopper, but they are unsuited for recirculation since they are in fact a mixture of at least two different coating compositions. The purpose of the described layer configuration is to have in the edge regions of the curtain a total rate of flow that is the combination of the rates of flow of two layers which is necessary, notably in those cases where relative thin layers are to be coated, when the individual layer rate of flow is too small to maintain a stable curtain, whereas the combined rate of flow of two layers does achieve a stable curtain.

Although the described arrangement does not permit the recirculation of the collected edge regions of the curtain, it does permit significant reduction of the waste of coating material since in a conventional curtain coater of the described type the collected edge regions of the curtain would be a mixture of the coating compositions of all four layers.

Although the ratio between the width of the edge regions of a curtain and the width of the complete or overall curtain is rather variable in practice, it should yet be taken into account that edge regions are seldom narrower than 5% of the total width of the curtain, and a reasonable lowest limit for the width of an edge region of the curtain is about 10 mm in the coating of relative small webs, say up to 200 mm, and about 50 mm in the coating of wider webs, say up to 1700 mm. An additional factor that should be considered is the accuracy of the lateral guidance of the web through the coating zone and in case relatively important deviations of the web from its intended path may occur, allowance should be made for such deviations in determining the width of the edge regions of the curtain.

The following examples further illustrate the invention.

EXAMPLE 1

Using a dual extrusion type hopper as illustrated in FIGS. 1 to 3 to form a free-falling composite curtain, a two layer coating was made on a polyethylene terephthalate web that was provided with a suitable subbing layer. The web had a width of 240 mm and was moved at a speed of 2 m/s. The angle between the radius of the roller running through the point of impingement of the curtain on the web, and the horizontal through the roller centre, as indicated by the angle $\alpha$ in FIG. 1, amounted to 60 degrees. The height of the curtain amounted to 60 mm.

The bottom layer 28 was an aqueous silver halide dispersion as used in the manufacturing of photographic film for graphic purposes, with a solid contents of 250 g/l and a viscosity of 16 mPa.s at 36° C. The dispersion contained carboxymethylated octylphenylether of polyethylene glycol containing 8 recurring ethylene oxide units as wetting agent in an amount of 0.5 g/l. The static surface tension of the composition was measured by means of a Wilhelmy plate and amounted to 36 mN/m.

The top layer 29 was a so-called antistress layer with a solid contents of 40 g/l and a viscosity of 4 mPa.s at 36° C. The composition contained sodium isotetradecyl sulphate as wetting agent in an amount of 0.17 g/l. The static surface tension amounted to 34 mN/m.

The respective widths were as follows:

a=400 mm
b=230 mm
c=364 mm
d=230 mm
e=240 mm

The wet layer thickness of the bottom layer was 50 $\mu$m, whereas the wet layer thickness of the top layer was 33 $\mu$m. The flow rate of the bottom layer was 75 $mls^{-1}m^{-1}$, whereas the flow rate of the top layer was 41 $mls^{-1}m^{-1}$. A photomicrograph of a cross section of the dried coating showed a distinct demarcation between the two layers.

The boundaries of the central region 29 of the curtain remained perfectly parallel with each other, as illustrated by the vertical broken lines in FIG. 2.

EXAMPLE 2

The foregoing example was repeated but now the aqueous silver halide bottom layer had a width corresponding with the central region of the curtain, whereas the antistress top layer covered the complete curtain width and was in contact with the curtain guides.

It was found that the rate of flow of the top layer had to be increased to 100 ml/s/m in order to prevent the edge regions of the curtain from becoming unstable. The corresponding minimum speed of the web to obtain a wet layer thickness of 33 $\mu$m for said layer, had to be increased to 3 m/s. The rate of flow of the silver halide bottom layer had correspondingly to be increased to 187 $mls^{-1}m^{-1}$ in order to obtain the same wet layer thickness as in example 1, namely 50 $\mu$m.

EXAMPLE 3

The example 1 was repeated, but now the concentration of the wetting agent in the antistress top layer was increased from 0.17 g/l to 2 g/l. The static surface tension of the composition was reduced thereby to 32 mN/m. As a consequence thereof, the edges of the central region of the curtain did no longer run parallel with each other but, on the contrary, they slightly diverged in the downward direction. In order that the width of said central region of the curtain be equal to that of the corresponding curtain region in example 1, measured on line 4—4 of FIG. 2, the length of the orifice 23 was reduced. The respective dimensions were as follows:

a=400 mm
b=225 mm
c=364 mm
d=230 mm
e=240 mm.

The rate of flow through the orifice 23 was correspondingly decreased to obtain finally the same wet layer thickness of 33 $\mu$m for said top layer.

The purpose of this example was to demonstrate that by the divergence of the narrower layer of the curtain, the thickness of the beaded edges of said layer on the web could be reduced, whereby the supplemental time that is required to dry said extra layer thickness, could be reduced.

The following data illustrate the improvement that was obtained.

The dry layer thickness of the two layers amounted to 10.2 $\mu$m measured at the centre of the web, and to 11.0 $\mu$m measured at a position situated 5 mm inwardly of an edge of the web, in the coating of example 1.

In the coating of the present example 3, on the contrary, the dry layer thickness at the centre was 10.2 $\mu$m, whereas said thickness amounted to 10.1 $\mu$m measured at said position situated b 5 mm inwardly of an edge of the web.

EXAMPLE 4

Using the dual extrusion type hopper illustrated in FIGS. 1 to 3 to form a free-falling curtain, a two-layer coating was made on a polyethylene terephthalate web, provided with a suitable subbing layer, to form an antihalation layer for a so-called graphic film.

The position of the coating head and the height of the curtain were the same as stated in example 1.

The bottom layer was an aqueous gelatin dispersion containing pigment particles for absorption of light that could penetrate through the web upon exposure of a light-sensitive layer on the reverse side of the web. The solid contents of the composition was 80 g/l and the viscosity was 11 mPa.s at 36° C. The composition contained sodium isotetradecyl sulphate as wetting agent in an amount of 0.21 g/l, and the static surface tension of the composition amounted to 34 mN/m. The top layer was an antistress layer with a solid contents of 30 g/l and a viscosity of 3 mPa.s at 36° C. The composition contained sodium isotetradecyl sulphate as wetting agent in an amount of 0.56 g/l. The static surface tension amounted to 29 mN/m. The wet layer thickness of the bottom layer was 50 μm whereas the wet layer thickness of the top layer was 20 μm.

In case the coating was carried out with the top layer covering the full curtain width, the bottom layer thus forming the central region of the curtain, it was found that the rate of flow of said top layer composition had to be greater than 100 $mls^{-1}m^{-1}$ in order to obtain stable edge regions of the curtain. The web speed that was required in these circumstances to obtain a wet layer thickness of 20 μm was 5 m/s. In an attempt to reduce this elevated value of the web speed, the marginal end regions 33 of the orifice 22 of the extrusion type head 10, see FIG. 6, were enlarged in thickness by 0.1 mm to locally increase the rate of flow at said regions. The nominal thickness of the orifice 22 was 0.4 mm. It was found that the rate of flow at the edge regions of the curtain was now 195 $mls^{-1}m^{-1}$. The necessary rate of flow was 100 $mls^{-1}m^{-1}$ so that the coating could now proceed at a web speed of 2.5 m/s for obtaining wet layer thicknesses of 50 and 20 μm, respectively.

In this way the drying capacity of an existing drier needed only to be half that of an installation that would have to operate at a web speed of 5 m/s.

EXAMPLE 5

Using the dual extrusion type hopper illustrated in FIGS. 1 to 3 to form a free-falling curtain, a two-layer coating was made on a polyethylene terephthalate web provided with a suitable subbing layer, to illustrate the effect of the viscosity of the layers on the curtain stability.

The position of the coating head and the height of the curtain as well as the dimensions a to e were the same as stated in example 1.

The bottom layer was an aqueous gelatin dispersion with a solid contents of 100 g/l and a viscosity of 150 mPa.s at 36° C. The composition contained sodium isotetradecyl sulphate as wetting agent in an amount of 0.21 g/l, and the static surface tension of the composition amounted to 30 mN/m.

The top layer was an aqueous gelatin dispersion with a solid contents of 50 g/l and a viscosity of 10 mPa.s at 36° C. The composition contained sodium isotetradecyl sulphate as wetting agent, in an amount of 0.14 g/l, and the static surface tension of the composition amounted to 32 mN/m.

The bottom layer was coated at full curtain width, whereas the top layer formed the central curtain region according to the dimensions a to e mentioned in example 1.

The wet layer thickness of the bottom layer amounted 50 μm and that of the top layer to 24 μm. The web speed was 1.5 m/s.

It was found that a rate of flow of 75 $mls^{-1}m^{-1}$ for the bottom layer made it very difficult to maintain stable operating characteristics for the edge regions of the curtain.

Therefore, the viscosity of the composition for the formation of the bottom layer was increased by the addition of suitable rheological compounds to 200 mPa.s, the solid contents remaining substantially unaltered. It was now found that the coating could proceed satisfactorily without any need to increase the rate of flow of said bottom layer.

EXAMPLE 6

Using a slide hopper coater of the type as illustrated in FIGS. 7 to 8, to form a free falling composite curtain, a three layer coating was made on a suitable film support for the production of a light-sensitive photographic material that is rapidly developable according to the so-called stabilization process. The slide hopper was provided with three parallel outlet orifices, two orifices having equal lengths and one orifice being 50 mm shorter and being also disposed on the slide surface between the two longer orifices. Edge dams or guides were only provided for the longer orifices and extended downwardly over the lip 50 to form the curtain guides.

The bottom layer was an aqueous gelatin composition with a viscosity of 9 mPa.s at 36° C. and a solid contents of 64 g/l. The wetting agent was carboxymethylated octylphenylether of polyethyleneglycol containing 8 recurring ethylene oxide units at a rate of 0.25 g/l whereby a static surface tension of 37.5 mN/m was obtained. The function of said layer is to form a water-permeable layer between the film support and the silver halide emulsion layer whereby a rapid transfer of the developing agent through the silver halide emulsion layer is obtained upon processing.

The middle layer was an aqueous silver halide composition and had a viscosity of 10 mPa.s at 36° C., and a solid contents of 270 g/l. As wetting agent was added sodium isotetradecyl sulphate in an amount of 0.17 g/l and carboxymethylated octylphenylether of polyethylene glycol containing 8 recurring ethylene oxide units in an amount of 0.75 g/l whereby a static surface tension of 30 mN/m was obtained. The top layer was a gelatin antistress layer with a viscosity of 3 mPa.s at 36° C., and a solid contents of 31 g/l. The wetting agent contained in the composition was sodium isotetradecyl sulphate in an amount of 0.28 g/l. The wet layer thickness of the bottom, the middle and the top layer was 62 μm, 42 μm and 33 μm respectively.

As in the present case the overflowing edge regions of the curtain (20 mm each) were in fact the sum of the flow rates of the bottom and the top layer, it became possible to coat at a minimum web speed that was considerably lower than if no such combination had taken place.

This result is a direct consequence of the formula: $R = v.d$ wherein

R is the rate of flow of the curtain in $mls^{-1}m^{-1}$, v is the velocity of the web in m/s, and d is the wet layer thickness in μm.

This formula applies to any curtain coater, and it may thus be seen that for a desired wet layer thickness, the velocity of the web may be lower in proportion to the rate of flow R.

In the present case, it was found that the minimum web speed at which satisfactory coating could occur was 1 m/s, what points to a rate of flow of 90 $mls^{-1}m^{-1}$ of the edge regions of the curtain. The limiting of the edge regions of the curtain to one layer only would increase the minimum web speed to 2 m/s, if the bottom layer only should form the edge regions of the curtain, and to 3 m/s in case the top layer only should form the edge regions of the curtain.

It will be understood that the present invention is not limited to the described embodiments and examples, and we refer to the patent literature of the last decenniads wherein numerous examples of the multi-coating of layers that still maintain their distinct relationship after coating and drying, have been disclosed.

It will finally be clear to the skilled artisan, that additional measures may be required in practice to make a curtain coating system operate satisfactory, such as air shields for removing air being carried along with the web and for reducing the air barrier which the free-falling curtain must penetrate, more sophisticated forms of edge guides, a vacuum manifold which is positioned adjacent the web to be coated to withdraw air from the web at the region of impact of the curtain, curtain guides that are easily adjustable to determine an optimal angle of convergence for the obtaining of a stable curtain, etc.

We claim:

1. In a method of applying to a travelling web a plurality of layers of at least one flowable composition, comprising moving said web along a predetermined pathm, delivering such flowable compositions to a plurality of slot-like orifices to form a plurality of distinct flowing layers of such compositions, flowing said layers into face to face contact with one another to form a composite layer and delivering said composite layer as a free-falling curtain onto said web at a locus extending transversely of said path, said curtain being held in said locus by adherent contact of its lateral edges with curtain guides, said curtain falling on said moving web, the improvement wherein at least one of said plurality of layers has a width greater than the width of the web, and at least one of said plurality of layers has a width smaller than the overall width of the curtain whereby at least one but not all of said plurality of layers are in adherent contact with the curtain guides.

2. Method according to claim 1, wherein the width of the portion of the curtain that contains all layers is substantially equal to the width of the web.

3. Method according to claim 1, wherein the width of the portion of the curtain that contains all the layers is smaller than the width of the web.

4. Method according to claim 3, wherein the web has knurled marginal regions and said width of said portion of the curtain corresponds with the width measured on the web between said knurled marginal regions.

5. Method according to claim 1, wherein only one layer of the composite curtain has a width sufficient to contact its lateral edges with the curtain guides, all the other layers have a lesser width.

6. Method according to claim 5, wherein the portion of said one, broader layer that overflows the edges of the web is collected and recirculated.

7. Method according to claim 5, wherein the rate of flow of said one layer of greater width is greater at the edge regions of the curtain than at the central region of the curtain.

8. Method according to claim 1, wherein the surface tension of the composition of each layer having a width greater than the web is higher than the surface tension of the composition of each layer of lesser width, thereby to obtain a curtain profile with diverging edges for the region of the curtain containing layers of both widths.

9. Method according to claim 1, wherein the viscosity of each layer of greater width exceeds the viscosity of each layer of smaller width.

10. In an apparatus for applying to a moving web a plurality of layers of at least one flowable composition, which comprises means for moving said web along a predetermined path, a plurality of elongate slot-like orifices, means for delivering to such orifices said flowable compositions to form a plurality of distinct flowing layers thereof, means for bringing the layers of coating compositions that have been formed by the flowing of such compositions through said orifice into superposed contact with each other to form a composite layer, and means for delivering the composite layer onto said moving web as a free-falling curtain at locus extending transversely of said path, and curtain guides at the lateral limits of said locus for adherent contact with the lateral edges of said curtain, the improvement wherein at least one of said plurality of slot-like orifices has a length that is substantially equal to the initial distance between the curtain guides, and at least one of said plurality of slot-like orifices is smaller in length than said distance between said guides.

11. Apparatus according to claim 10, wherein one slot-like orifice alone has a length that equals the distance between the curtain guides, all the other orifices being of lesser length.

12. Apparatus according to claim 10, wherein at least one orifice having a length that corresponds with the initial distance between the curtain guides has edge regions of increased orifice thickness thereby to produce in operation a rate of flow of composition through the edge region of such orifice that is greater than the rate of flow through the corresponding central region of said orifice.

13. Apparatus as in claim 10, wherein the centers of said plurality of orifices are disposed in one common central plane.

* * * * *